US008235470B2

(12) United States Patent
Zimmerman et al.

(10) Patent No.: US 8,235,470 B2
(45) Date of Patent: Aug. 7, 2012

(54) CUTTER HEAD CONTAINING ITS MOTORS AND GEARCASE

(75) Inventors: Joseph J. Zimmerman, Franklin, PA (US); Garrett L. Lowman, Polk, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 191 days.

(21) Appl. No.: 12/647,158

(22) Filed: Dec. 24, 2009

(65) Prior Publication Data

US 2011/0156470 A1 Jun. 30, 2011

(51) Int. Cl.
*E21C 27/24* (2006.01)
*F16H 3/00* (2006.01)

(52) U.S. Cl. ..... 299/76; 475/5

(58) Field of Classification Search ..... 299/29, 299/39.1, 39.2, 39.4, 39.5, 39.6, 40.1, 58, 299/76, 78, 79.1, 80.1; 475/331, 332, 338, 475/341, 342, 903, 149, 150, 303, 5
See application file for complete search history.

(56) References Cited

U.S. PATENT DOCUMENTS 4,047,763 A * 9/1977 Gilliland et al. ..... 299/76
5,964,507 A 10/1999 Blackstock et al.

FOREIGN PATENT DOCUMENTS

| | | |
|---|---|---|
| DE | 3829225 | 3/1990 |
| GB | 1359204 | 7/1974 |
| GB | 1506975 | 4/1978 |
| GB | 2018329 | 10/1979 |
| GB | 2060032 | 4/1981 |
| GB | 2251878 | 7/1992 |
| JP | 57066214 | 4/1982 |

OTHER PUBLICATIONS

Great Britain Search Report for Application No. GB1021632.3, dated Mar. 8, 2011 (6 pages).

* cited by examiner

*Primary Examiner* — Sunil Singh
(74) *Attorney, Agent, or Firm* — Michael Best & Friedrich LLP

(57) ABSTRACT

An apparatus for mining a mineral seam, comprising a motor, and a cutting drum carried on the frame for winning aggregate material from the mineral seam. The cutting drum encloses the motor, and a gear case drivingly connected between the motor and the cutting drum transmits power from the motor to the cutting drum. The gear case is also enclosed within the cutting drum.

22 Claims, 6 Drawing Sheets

CUTTER HEAD CONTAINING ITS MOTORS AND GEARCASE

BACKGROUND

This disclosure relates to a cutter head for a mining machine, and more particularly, to a mechanism for delivering power to the cutter head of a mining apparatus, such as a continuous miner.

As shown in FIGS. 1 and 2, a conventional mining machine 10 includes a main frame 12 supported for movement or propulsion relative to the ground by means of crawler or caterpillar assemblies 14, one on each side of the mining machine. The crawler assemblies 14 are powered by electric or hydraulic motors (not shown) carried on the frame 12 in a manner well known in the art.

The mining machine 10 also includes a means, generally designated by reference numeral 16, for cutting an opening in and winning aggregate material from the mineral seam. More particularly, the cutting and winning means 16 is carried on the forward end of a boom 20 that is pivotally mounted to the frame 12. The cutting drum assembly 18 includes a series of picks 19 for ripping, breaking or cutting aggregate material from the mineral seam for subsequent recovery.

The boom 20 includes a bulkhead 21 that interconnects a pair of spaced, lateral arms 22, each arm being pivotally mounted to the frame through a trunnion (not shown). A pair of hydraulic actuators 24 allows the selective angular positioning of the boom 20 relative to the frame 12. Thus, the boom 20 and, therefore, the cutting drum assembly 18 may be raised and lowered as the mining machine 10 is advanced into the mineral seam so that aggregate material is cut from the full vertical dimension of the seam. This material is collected in an underlying loading shovel 26 and delivered into a twin chain conveyor 28 for subsequent recovery in a manner known in the art. Each arm 22 carries one motor 30 and a cooperating gear case 32 (see FIG. 2) to drive the cutting drum assembly 18. The gear case 32 includes webs 34 that connect the cutting drum assembly 18 to the bulkhead of the boom 20. The webs 34 are the portion of the gear case 32 that connects the actual cutting drums to the cutting boom and therefore to the rest of the machine.

One common mode of failure of the above conventional continuous miner is crushing of the webs. Not only do these webs have to handle large forces from the cutting of materials, they traditionally need to provide for a means of transmitting mechanical power from cutting motors to the cutting drum. This power transmission is usually accomplished through a complex set of gears and shafts that run through the web, as shown in FIG. 2. To allow for this power transmission, the webs 34 must have much of their material machined away, thereby greatly reducing the overall strength of the web. In certain circumstances, when a piece of material or broken cutter bit gets jammed against these webs, it can cause the webs to crush in. When this occurs, the web material may come into contact with the shafts or gears that are running through the web, causing failure of the machine.

SUMMARY

The object of this disclosure is to eliminate the need to transmit mechanical power through the webs.

This disclosure thus provides an apparatus for mining a mineral seam, comprising a motor, and a cutting drum carried on the frame for winning aggregate material from the mineral seam. The cutting drum encloses the motor, and a gear case drivingly connected between the motor and the cutting drum transmits power from the motor to the cutting drum. The gear case is also enclosed within the cutting drum.

The cutter head of this disclosure is the first continuous miner cylindrical cutter head with one or more (typically two) cutting motors contained in the cutting drums. It is also the first double planetary gear train utilizing a compound planetary gear set located inside the cutter head.

The cutter head of this disclosure eliminates several problems that occur with the current design of cutter heads. The cutter head of this disclosure also reduces the number of parts and complexity of the cutting system.

The cutter head employs a rigid gear case in the cutting drum assemblies that not only houses the cutting motors and gear train, but also provides greater torsional strength over existing models of continuous miners. The cutter head of this disclosure also makes the cutting head more easily expandable by using a modular design to simply increase its width to allow room for a larger motor, thereby greatly enhancing the machines overall capabilities and productivity. The cutter head of this disclosure also costs less to produce than a conventional current cutter head because of its reduced complexity. The cutter head of this disclosure also affords a lower cost cutter boom and enables the cutter boom to be narrower, to accommodate roof-bolting drills, for example. Another added benefit is that the cutter motor mass now moves forward, where it will add to the cutting efficiency of the machine. The cutter head of this disclosure also utilizes a simpler gear train than that used in conventional miners. The new gear train also has fewer unique individual parts, which reduce manufacturing costs and required spare parts inventory.

Figure 1:
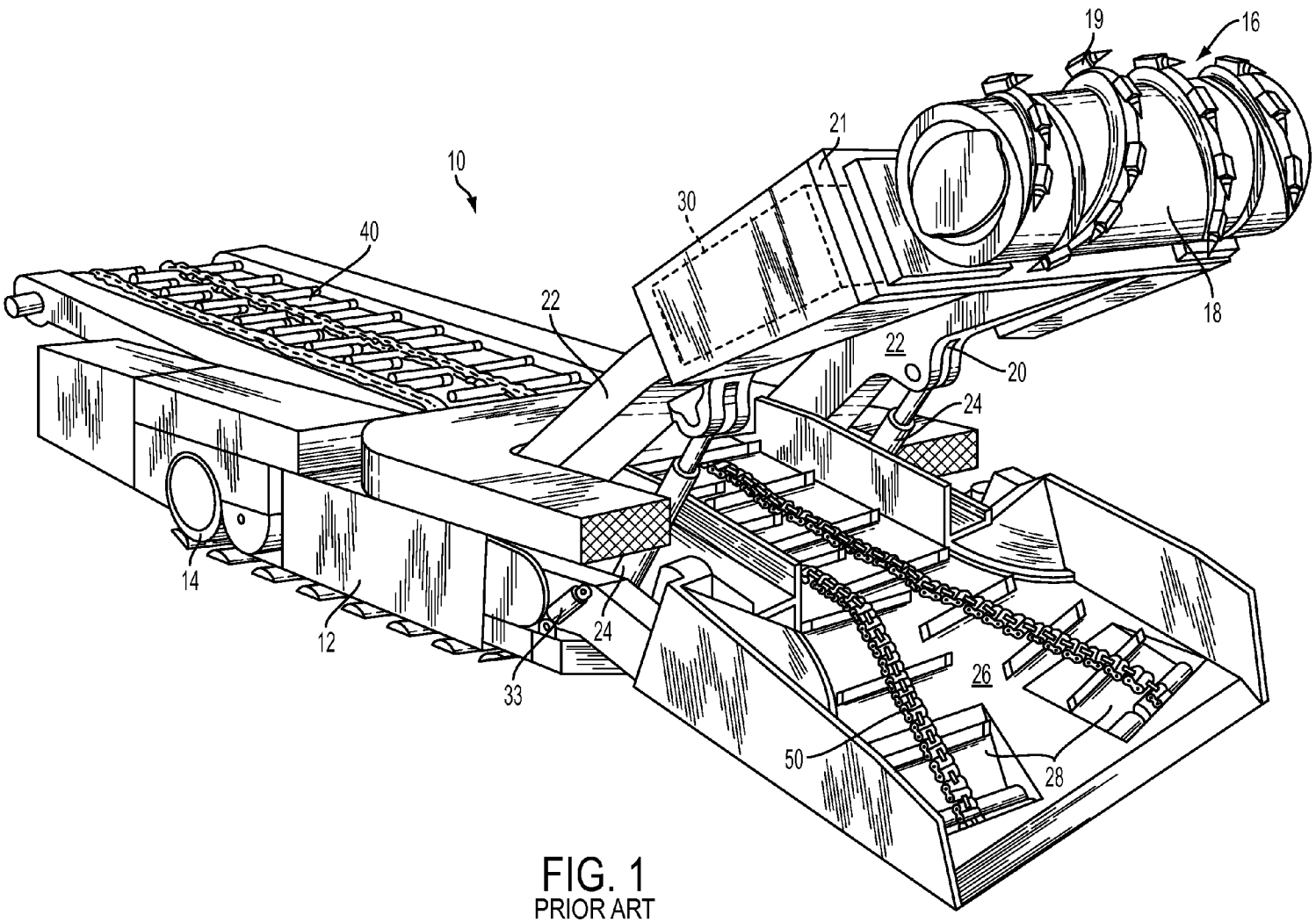
FIG. 1 PRIOR ART
FIG. 1 is a perspective view showing a prior art mining apparatus.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

Figure 2:
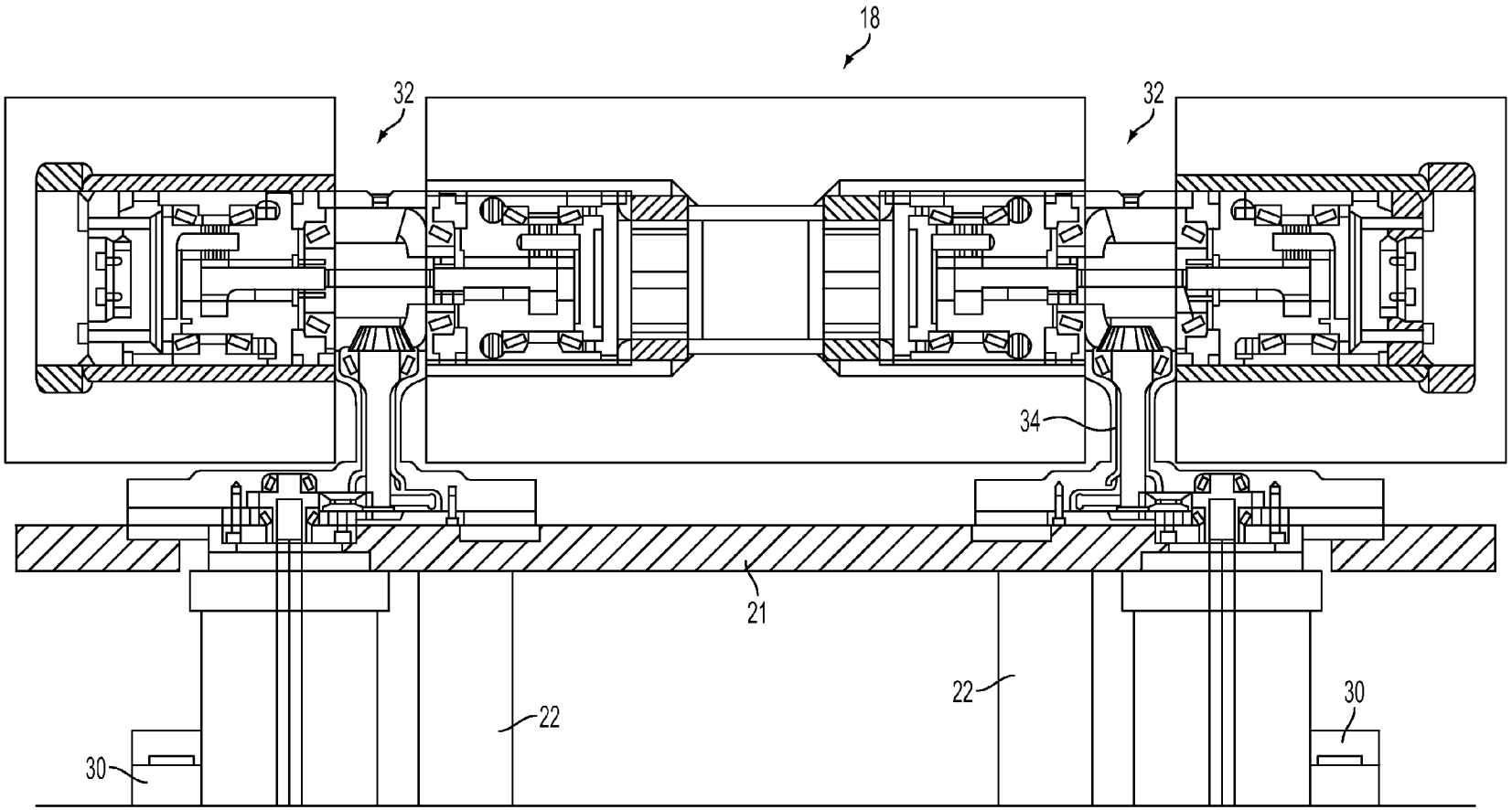
FIG. 2 PRIOR ART
FIG. 2 is a partially cross-sectional view of the mining apparatus shown in FIG. 1, illustrating the boom, cutter drum assembly and cutter drum transmission.

FIGS. 3 through 6 illustrate a boom and cutter head assembly 100 for a continuous miner. The boom and cutter head assembly replace the means, generally designated by reference numeral 16, for cutting an opening in and winning aggregate material from the mineral seam, shown in FIGS. 1 and 2.

Figure 3:
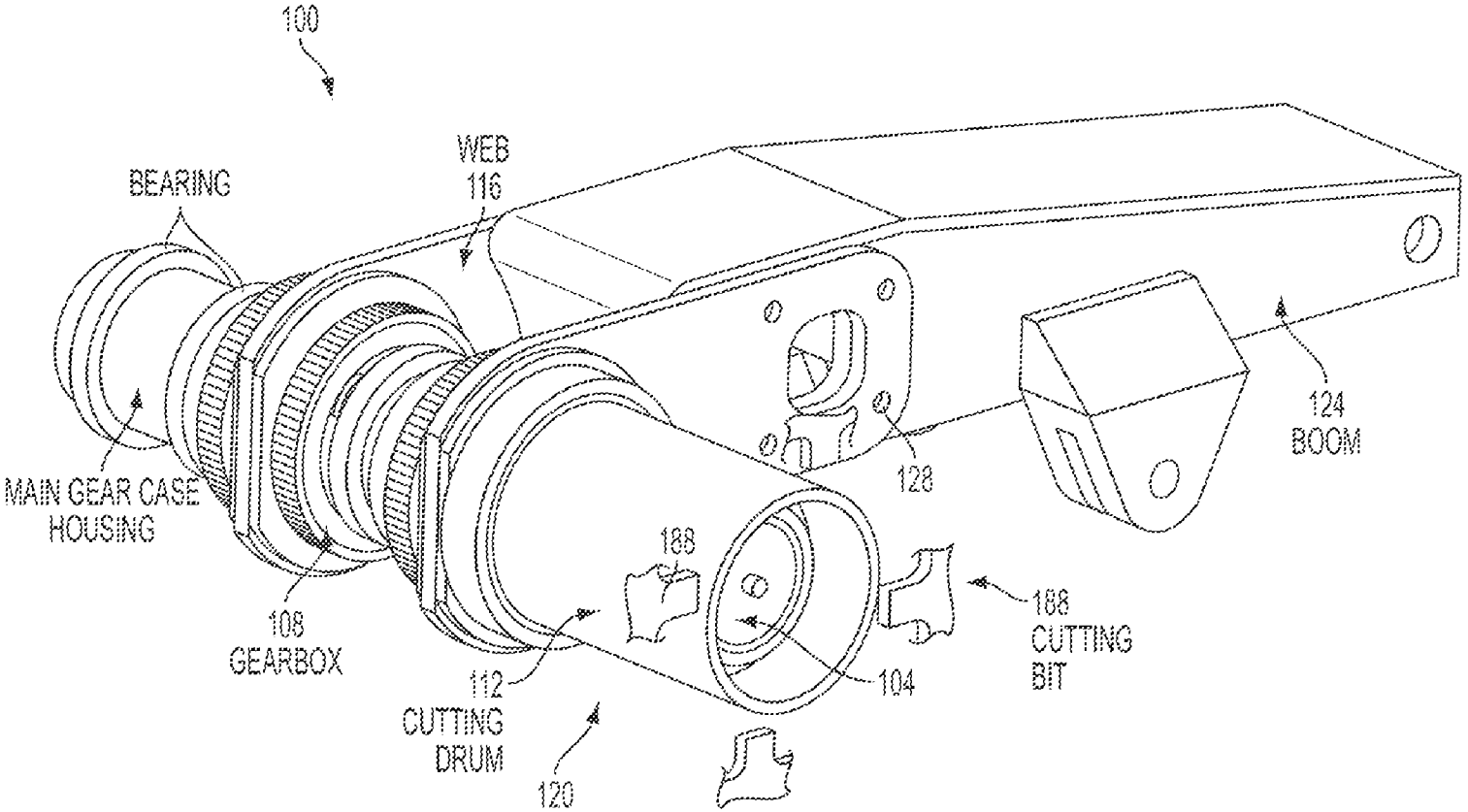
FIG. 3 is a perspective view of a mining apparatus including a boom and a cutter head according to this disclosure, with the center and left cutting drum's removed. Only some cutting bits are visible.

FIG. 3 is a perspective view of a mining apparatus including a boom 124 and a cutter head 120 according to this disclosure, with the center and left cutting drum's removed. Only some cutting bits 188 are visible. More particularly, the boom and cutter head assembly 100 includes cutting motors 104 and a gearbox 108 entirely within a cutting drum 112. The assembly 100 further includes two spaced apart webs 116 that connect the cutter head 120 to the boom 124. The webs 116 are made from steel plates, and are each attached by bolts 128 to a respective side of the boom 124.

The webs 116 include openings (not shown) to allow for electric and wire lines to power and cool the motors as well as provide a supply of water for water sprays to control dust wall mining. These openings are smaller than in a conventional web, where the openings provide space for gearing to connect the cutter head gearing for rotation to a remote drive.

Figure 4:
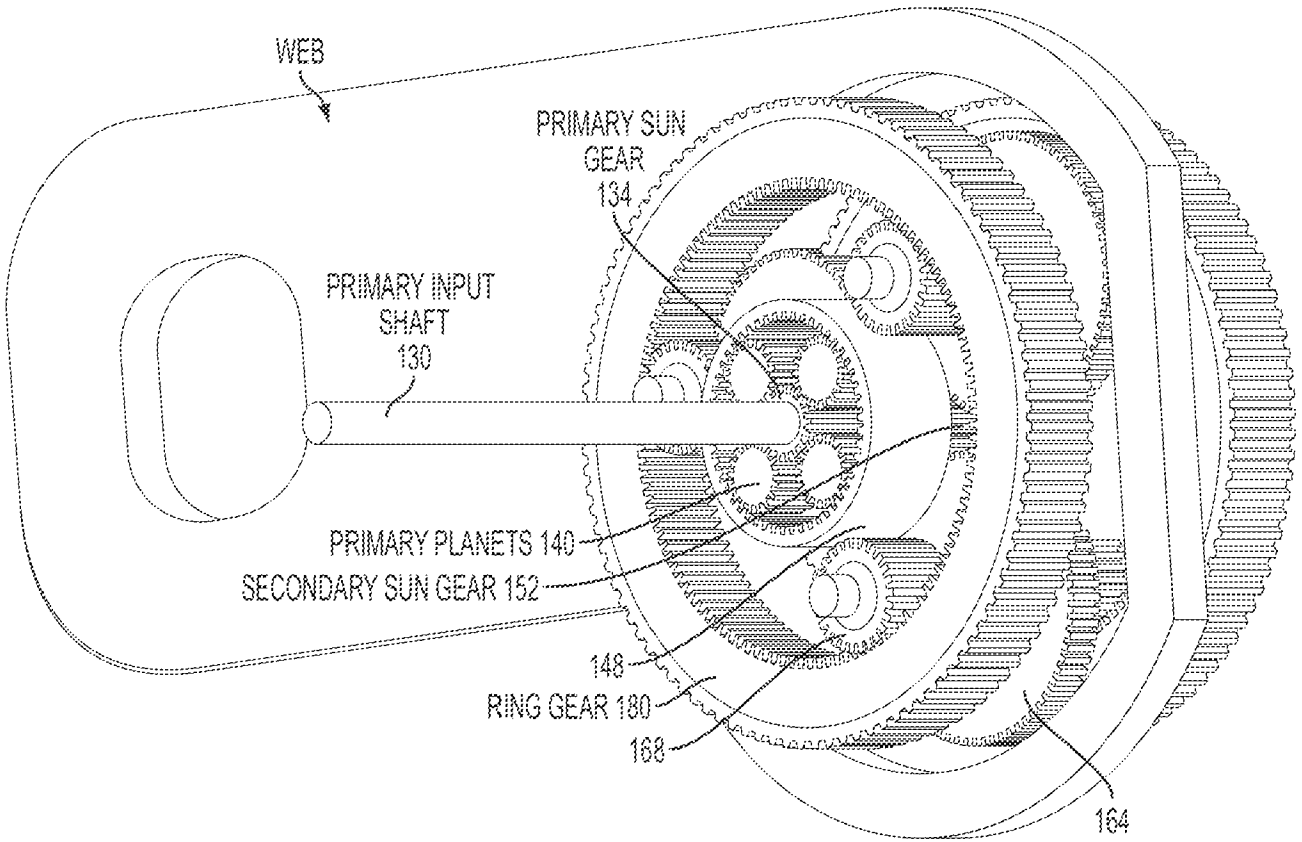
FIG. 4 is a perspective view of a gear train inside the web of the mining apparatus of FIG. 3.
Figure 5:
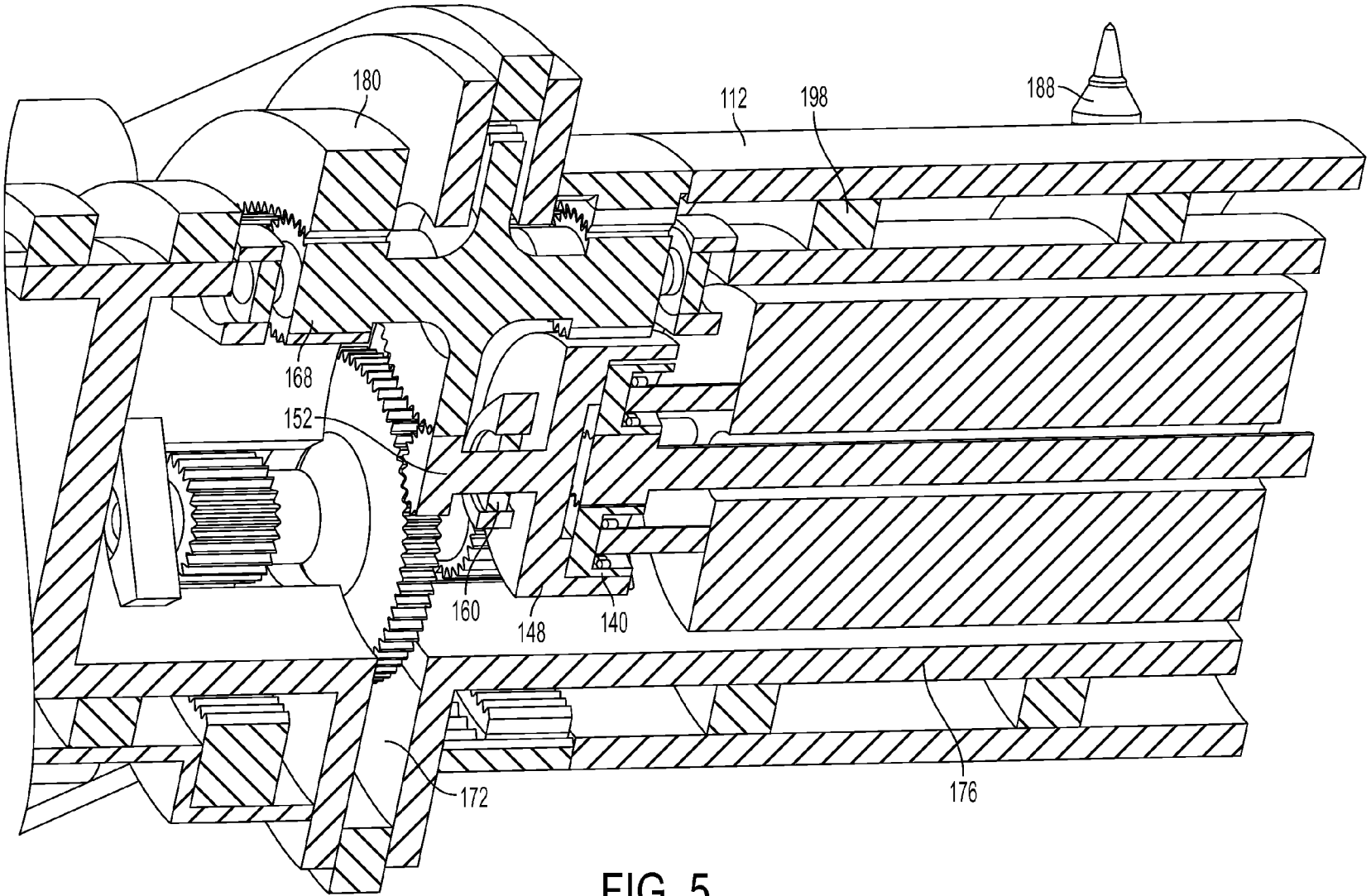
FIG. 5 is a left side perspective view of the gear train inside the main gear case housing of the mining apparatus of FIG. 3.
Figure 6:
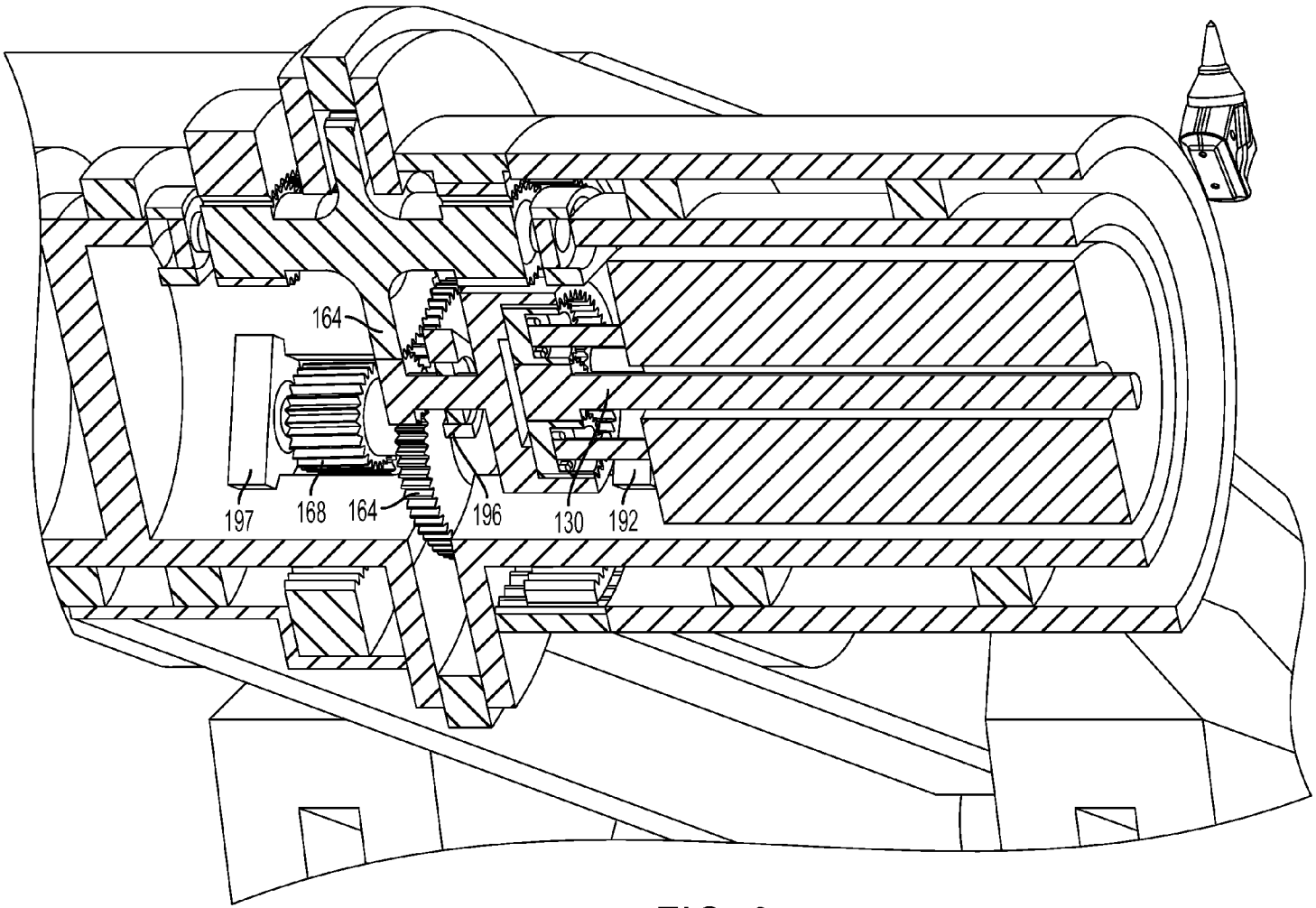
FIG. 6 is a right side perspective view of the gear train inside the main gear case housing of the mining apparatus of FIG. 3.

Electric power is transmitted through the webs 116 and into the electric motors 104 where it is transformed into mechanical rotating power, which needs to go through a speed reduction and torque amplification process before it can effectively be used for mining purposes. As illustrated in FIGS. 4, 5 and 6, this rotational power exits the motor 104 via a shaft 130 that connects to a sun or central gear 134 of a primary planetary gear set. This sun gear 134 then transmits the power to planet gears 140. These planet gears 140 mesh with an internal annulus gear 148 that provides the output of the primary gear set. Power is then transmitted from the annulus gear 148 to a sun gear 152 (see FIG. 5) of a secondary compound planetary set via another shaft 160. It is important to note that the secondary sun gear 152 is the output for the primary planetary set, as well as the input for the secondary planetary set. The rotational power is transmitted from this sun gear 152 to a set of large, non-orbiting planet gears 164. These planet gears 164 are not meshing with an annulus at their full diameter, as would be the case in a normal planetary set. Instead, there is a spur gear 168 attached to each side of every planetary gear 164. These spur gears 168 share the same axis of rotation as the large planet gears 164. These spur gears 168 protrude through openings 172 in a main gear case housing 176, permitting them to transfer power outside of the main housing 176. Two such spur gear and planetary gear combinations are shown in each of FIGS. 5 and 6.

On the outside of the housing 176, the spur gears 168 mesh with large ring gears 180. These ring gears 180 are then attached either directly to the cutting drum 112, or through an intermediate inner drum (not shown) that is then attached to the cutting drum 112. The cutting drum rotate relative to ribs 198 on the main gear case housing 176. Appropriate bearings (not shown) are between the ribs 198 and the cutting drum 112, and between the various gears and their supports. Power is transmitted from the cutting drum 112 into actual cutting forces to mine material through the use of the cutting bits 188.

The axes of all of the above gears are fixed relative to the main gear case housing 176. Each gear can spin, but it does not otherwise rotate around another gear. For example, none of the planetary gears revolve around a sun gear. In FIG. 6, one of the supports 192 for fixing of the primary planetary gears to the main gear case housing is shown. Further, the supports 196 for the secondary sun gear, as well as the supports 197 for the spur gears 168, are also shown in FIGS. 5 and 6.

In the illustrated embodiment, a gear reduction is provided between the motor shaft and the secondary sun gear. In other embodiments (not shown), if no reduction were needed, the motor shaft could directly drive the sun gear 152.

Various other features and advantages of the disclosure are apparent from the following claims.

The invention claimed is:

1. A cutter head comprising:

a drum including a first portion having a first ring gear and a second portion having a second ring gear, the drum being rotatable about a drum axis;

a first motor positioned within the drum, the first motor having an output shaft;

a first sun gear coupled to the first motor output shaft; and at least one first gear cluster, the first gear cluster including a planetary gear engaging the first sun gear, a first spur gear coupled to a first side of the planetary gear, and a second spur gear coupled to a second side of the planetary gear, wherein the first spur gear engages the first ring gear to rotate the first portion of the drum and the second spur gear engages the second ring gear to rotate the second portion of the drum.

2. The cutter head of claim 1, wherein the planetary gear and the spur gears have the same axis of rotation, which is parallel to the drum axis.

3. The cutter head of claim 1, wherein the planetary gear is located between the first portion and the second portion of the drum, such that the first spur gear extends toward the first portion and the second spur gear extends toward the second portion.

4. The cutter head of claim 1, wherein the first sun gear is coupled to the first motor output shaft by a gear train, such that the first motor output shaft engages a plurality of second planetary gears, the second planetary gears rotating an inner annulus that is formed integrally with the first sun gear.

5. The cutter head of claim 1, and further comprising a second motor having an output shaft and at least one second gear cluster, the second motor output shaft being coupled to a second sun gear, the at least one second gear cluster including a planetary gear engaging the second sun gear, a third spur gear coupled to a first side of the planetary gear, and a fourth spur gear coupled to a second side of the planetary gear.

6. The cutter head of claim 5, the drum further including a third portion including a third ring gear, wherein the third spur gear engages the third ring gear to rotate the third portion of the drum.

7. The cutter head of claim 5, the second portion further including a fourth ring gear, wherein the fourth spur gear engages the fourth ring gear to rotate the second portion of the drum.

8. A mining machine comprising:

a boom including at least one web; and a cutter head supported by the at least one web, the cutter head including a drum having a first portion and a second portion, the drum being rotatable about a drum axis;

a first motor positioned within the drum, the first motor having an output shaft;

a first sun gear coupled to the first motor output shaft; and at least one first gear cluster, the first gear cluster including a planetary gear engaging the first sun gear, a first spur gear coupled to a first side of the planetary gear, and a second spur gear coupled to a second side of the planetary gear, wherein the first spur gear rotates the first portion of the drum, and the second spur gear rotates the second portion of the drum.

9. The mining machine of claim 8, wherein the web includes a passage for conduit for supplying power to the motor.

10. The mining machine of claim 8, wherein the planetary gear and the spur gears have the same axis of rotation, which is parallel to the drum axis.

11. The mining machine of claim 8, wherein the planetary gear is located between the first portion and the second portion of the drum, such that the first spur gear extends toward the first portion and the second spur gear extends toward the second portion.

12. The mining machine of claim 8, wherein the first sun gear is coupled to the first motor output shaft by a gear train, such that the first motor output shaft engages a plurality of second planetary gears, the second planetary gears rotate an inner annulus that is formed integrally with the first sun gear.

13. The mining machine of claim 8, the first portion of the drum further including a first ring gear, and the second portion further including a second ring gear, wherein the first spur gear rotates the first portion of the drum by engaging the first ring gear, and the second spur gear rotates the second portion of the drum by engaging the second ring gear.

14. The mining machine of claim 8, and further comprising a second motor having an output shaft and at least one second gear cluster, the second motor output shaft being coupled to a second sun gear, the at least one second gear cluster including a planetary gear engaging the second sun gear, a third spur gear coupled to first side of the planetary gear, and a fourth spur gear coupled to a second side of the planetary gear.

15. The mining machine of claim 14, the drum further including a third portion including a third ring gear, wherein the third spur gear engages the third ring gear to rotate the third portion of the drum.

16. The mining machine of claim 14, the second portion of the drum further including a fourth ring gear, wherein the fourth spur gear engages the fourth ring gear to rotate the second portion of the drum.

17. A drive system for a cutter head of a mining machine, the cutter head defining a cutter head axis and being supported on the mining machine by multiple webs, the cutter head including a first portion, a second portion, and a third portion, the second portion being positioned between the first portion and the third portion, the drive system comprising:

a first motor positioned proximate the first portion of the cutter head, the first motor including a first output shaft coupled to a first sun gear;

a second motor positioned proximate the third portion of the cutter head, the second motor including a second output shaft coupled to a second sun gear;

a first gear cluster including a first planetary gear and a first spur gear coupled to one side of the first planetary gear, the first planetary gear engaging the first sun gear, such that the first spur gear drives the first portion of the cutter head; and a second gear cluster including a second planetary gear and a second spur gear coupled to one side of the second planetary gear, the second planetary gear engaging the second sun gear, such that the second spur gear drives the third portion of the cutter head.

18. The drive system of claim 17, wherein the planetary gear and the spur gears for each gear cluster have the same axis of rotation, which is parallel to the cutter head axis.

19. The drive system of claim 17, wherein the first gear cluster is located between the first portion and the second portion of the drum, and the second gear cluster is positioned between the second portion and the third portion of the drum.

20. The drive system of claim 17, wherein the first spur gear drives the first portion of the cutter head by engaging a first ring gear coupled to the first portion, and the second spur gear drives the third portion of the cutter head by engaging a second ring gear coupled to the third portion.

21. The drive system of claim 17, the first gear cluster further including a third spur gear coupled to the other side of the first planetary gear, and the second gear cluster further including a fourth spur gear coupled to the other side of the second planetary gear, wherein the third spur gear and the fourth spur gear drive the second portion of the cutter head.

22. The drive system of claim 21, wherein the first spur gear drives the first portion of the cutter head by engaging a first ring gear coupled to the first portion, the second spur gear drives the third portion of the cutter head by engaging a second ring gear coupled to the third portion, and the third spur gear and the fourth spur gear drive the second portion of the cutter head by engaging a third ring gear and a fourth ring gear, respectively, the third ring gear and the fourth ring gear being coupled to the second portion of the cutter head.

* * * * *